United States Patent [19]

Fröderberg

[11] Patent Number: 4,482,283

[45] Date of Patent: Nov. 13, 1984

[54] REFUSE COLLECTING VEHICLES

[75] Inventor: Kenneth Fröderberg, Blomstermåla, Sweden

[73] Assignee: Norba Aktiebolag, Blomstermala, Sweden

[21] Appl. No.: 372,557

[22] Filed: Apr. 28, 1982

[30] Foreign Application Priority Data

May 4, 1981 [SE] Sweden ..... 8102769

[51] Int. Cl.[3] ..... B65F 3/00

[52] U.S. Cl. ..... 414/492; 414/525 R

[58] Field of Search ..... 414/293, 525 R, 491–493, 414/526, 304, 325; 100/145, 117, 70 R, 75; 222/108, 559, 561; 296/38

[56] References Cited

U.S. PATENT DOCUMENTS

| | | | |
|---|---|---|---|
| 449,421 | 3/1891 | Kearney | 296/38 X |
| 3,212,656 | 10/1965 | Kamin | 296/38 X |
| 3,695,172 | 10/1972 | Cleary et al. | 100/70 |
| 3,738,546 | 6/1973 | Speicher | 222/561 |
| 3,968,891 | 7/1976 | Perkins | 414/525 |
| 4,161,255 | 7/1979 | Robert | 414/325 X |
| 4,256,035 | 3/1981 | Neufeldt | 100/145 |

*Primary Examiner*—Leslie J. Paperner
*Assistant Examiner*—David A. Bucci
*Attorney, Agent, or Firm*—Hubbell, Cohen, Stiefel & Gross

[57] ABSTRACT

This invention relates to improvements in refuse trucks and similar vehicles comprising a removable or upwards pivotable collecting container (7) for the waste or refuse as well as a loading hopper (15) or the like which is located beside the container on the refuse vehicle and is provided with means for compressing the refuse and transferring it from the loading hopper to the collecting container through mutually registering openings in adjacent walls facing each other of the loading hopper (15) and the collecting container (7), respectively.

When the collecting container (7) has become filled and is to be emptied, it is separated from the loading hopper (15), thereby rupturing a refuse string extending from the loading hopper into the collecting container. This rupture has the almost unavoidable consequence that some waste comes loose and drops to the ground. For avoiding such littering there is provided under that end of the collecting container (7) with is adjacent to the loading hopper (15), a spill box (19) which is open at its top and at least substantially covered by said container end when the collecting container is not pivoted upwards or removed. The spill box preferably projects from the container in the direction towards the loading hopper, beyond at least one (13) of said walls.

12 Claims, 8 Drawing Figures

REFUSE COLLECTING VEHICLES

BACKGROUND OF THE INVENTION

This invention relates to an improvement in refuse collecting vehicles of the kind generally defined in the preamble of claim 1.

In one known type of such refuse collecting vehicles means are provided for swinging (up) the refuse container on a horizontal axis extending transversely with respect to the refuse truck and usually located adjacent that end of the collecting container which is remote from the load hopper. After that the lowermost end wall of the inclined, filled container is opened and the refuse is fed out through the opening of the wall.

In other refuse trucks of the prior art, whose collecting containers are provided with pivotable legs, the containers after having been filled are first lifted after which the legs are swung down. Subsequently the container is freed from its lifting means and lowered, so that it will rest upon the ground with its legs, free from the refuse truck which can now be provided with a new, empty container.

In each of these two cases the garbage string which extends from the load hopper into the collecting container is ruptured or cut off at the raising or pivoting up of the collecting container. During this step it is almost unavoidable that some refuse comes loose and falls down to the ground.

SUMMARY OF THE INVENTION

The primary object of the invention is to eliminate this drawback and thereby prevent littering of the ground in connection with the separation of a collecting container from an appurtenant load hopper. This object is attained thanks to the fact that the device, according to the invention is so designed as is set forth in the characterizing clause of claim 1.

BRIEF DESCRIPTION OF THE DRAWINGS

Further features and advantages of the device according to the invention will become apparent from the following detailed description and the annexed drawings which diagrammatically and as non-limiting examples illustrate a preferred embodiment of the invention.

In FIG. 1 there are illustrated, very diagrammatically and in a side view, those portions of a refuse collecting truck which are affected by the invention. The driver's cab (not shown) of the truck is presumed to be located to the left of the Figure, and the rear end of the truck (not shown) is then supposed to be located to the right of the FIG. 1 designates a frame beam which forms part of the chassis of the refuse truck. In the chassis there is secured by means of bolts a bracket 2*a*, 2*b*, 2*c*, which is shown to be substantially T-shaped in the drawing, for a hydraulic pivot or lifting cylinder 3. The piston rod 4 of the cylinder is pivotally connected at 5 to a support beam 6 which carries a refuse collecting container 7 (only partially shown) which is rigidly united with the beam 6. 8*a* and 8*b* designate reinforcement members for the collecting container, whose bottom or lower edge is designated 9. The beam 6 has a tenon 10 which, except when the container is to be emptied or removed from the refuse truck, engages a recess in a bracket 11 which is permanently secured to the reinforcement member 2*c* by means of a plate or the like 12. 13 represents the fore end or front of the collecting container 7.

Figure 1:
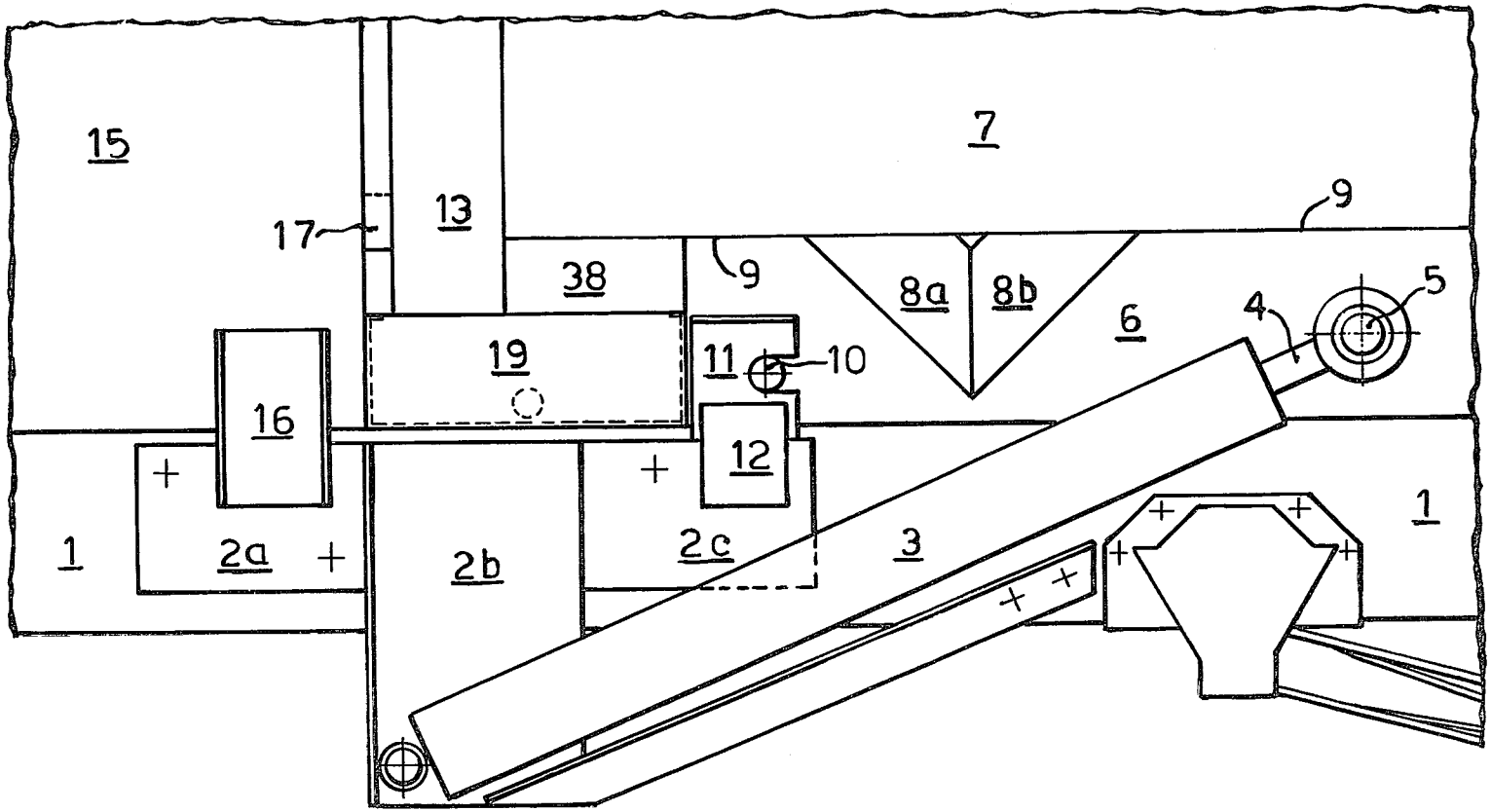
FIG. 1 is a side view of part of a refuse collecting vehicle and illustrates the mutually adjacent portions of the loading hopper and the collecting container as well as a spill box provided under the latter according to the invention.
Figure 2:
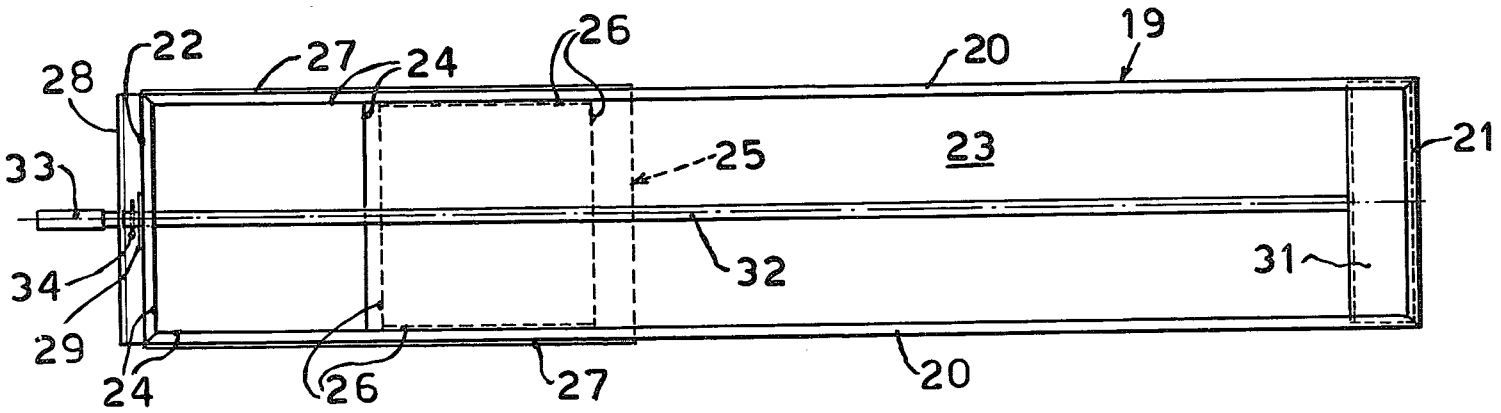
FIG. 2 is a plan view of the spill box and an appurtenant displaceable bottom plate which serves as a "shutter".
Figure 3:
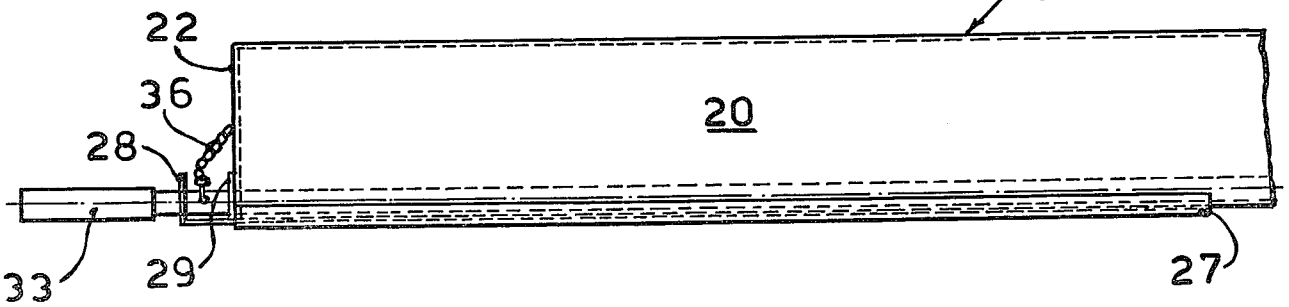
FIG. 3 is a side view on a larger scale of the left-hand portion of the spill box in FIG. 1.
Figure 5:
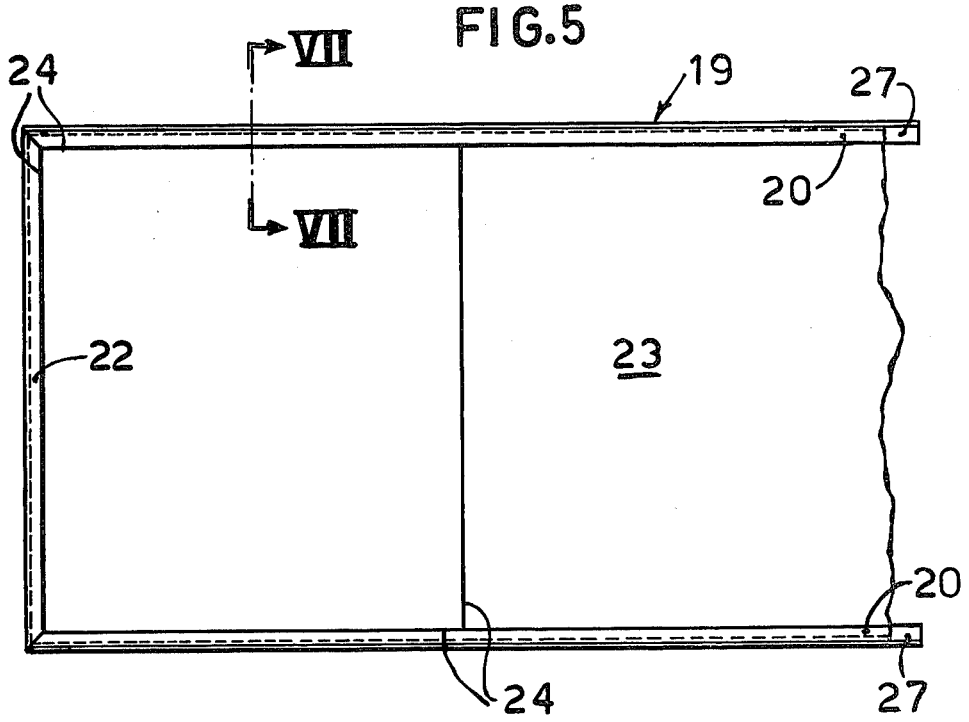
FIG. 5 is a plan view corresponding to FIG. 3 of part of the spill box without its bottom plate.
Figure 4:
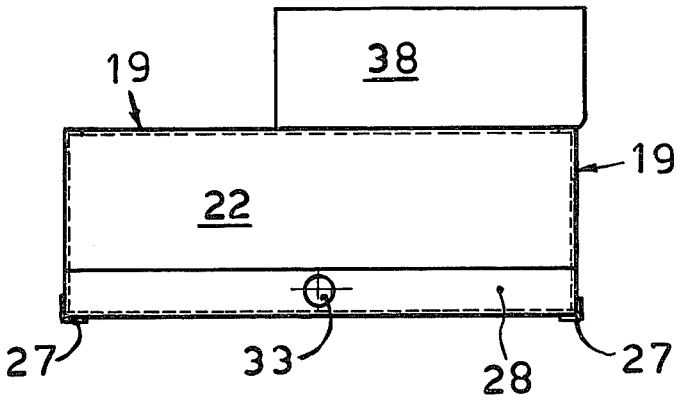
FIG. 4 is an end view of the spill box on a larger scale.
Figure 6:
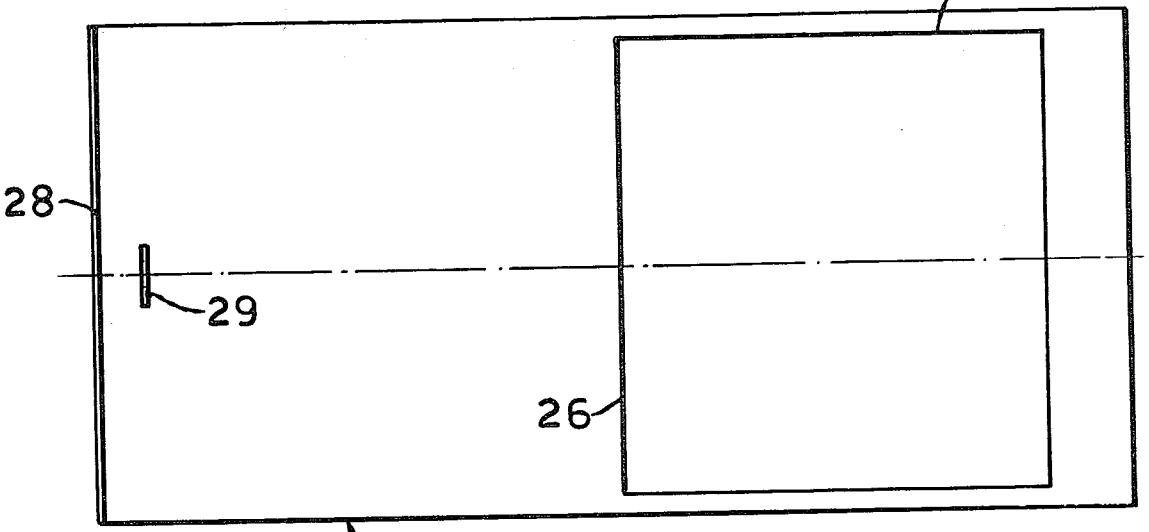
FIG. 6 is a plan view of the bottom plate.

15 designates the loading hopper which is shown only in part and is welded to the reinforcement member 2*a* through the intermediary of a U-shaped plate 16. 17 is a ring-shaped gasket or washer which is located in the interspace between the rear wall of the loading hopper 15 and the front wall 13 of the collecting container and surrounds openings (not shown) located opposite each other in said front and rear walls. A pressure screw provided in the loading hopper feeds the refuse while compressing it from the loading hopper into the collecting container 7 through these openings.

The spill box which is provided according to the invention and is designated 19 is disposed under the collecting container 7 and is at least as long as the width of the collecting container. In its transverse direction the spill box 19 projects into the interspace between the collecting container and the loading hopper 15, preferably at least right up to the hopper.

The spill box 19 is more explicitly shown in FIGS. 2–8. It comprises two longitudinal walls 20, two transverse or end walls 21, 22, of which the latter may be regarded as the "front" of the spill box in this disclosure. In the bottom 23 of the box an opening 24 is provided adjacent the front 22 of the box as is most clearly shown in FIG. 5. The opening 24 is normally, i.e. except just after an emptying of the collecting container 7, closed by means of a displaceable bottom plate which is generally designated 25 and is shown separately in FIG. 6. The length of the plate 25 is more than twice the extension of the opening 24 as seen in the longitudinal direction of the box. The plate 25 has an opening 26 which has substantially the same dimensions as the opening 24 and is displaced with respect thereto in the longitudinal direction of the spill box to such an extent that the two openings are located completely beside each other in the normal pushed-in position of the plate 25, as is apparent from FIG. 2. The plate 25 is slidably carried by a pair of L-profile rails 27 which are shown in FIGS. 2–5 and 7 and has a turned-up fore edge 28 which projects beyond the front 22 of the spill box. Inside its front the plate 25 has a central stop 29 which co-operates with the front of the spill box.

Figure 8:
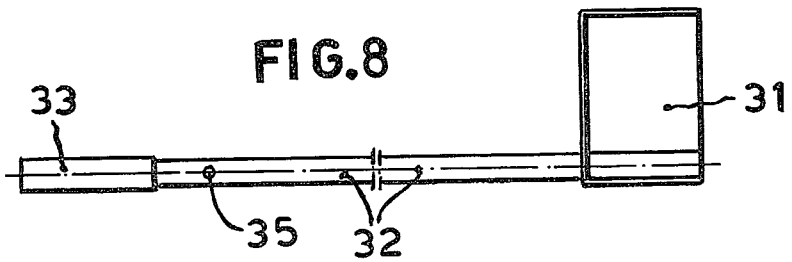
FIG. 8 is a side view of a rake.
Figure 7:
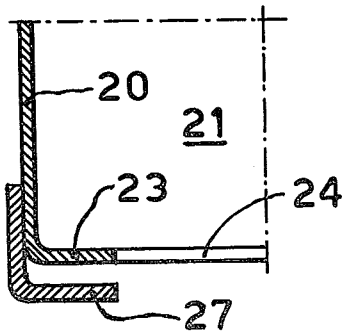
FIG. 7 is a cross sectional view on line VII-VII in FIG. 5 rotated 90° counter-clock-wise and illustrating a detail on a larger scale.

The spill box 19 is also provided with a rake or piston 31 which can be pulled out and pushed in and is illustrated separately in FIG. 8. To the rake 31 a pull rod 32 is secured which passes through guide openings or recesses in the front 22 of the box and the fore edge 28 of the plate. The pull rod 32 has a grip 33 in its free end. A locking pin or the like 34 (FIG. 2) which may be inserted into an aperture 35 (FIG. 8) in the pull rod 32 and is attached to one end of a chain 36 (FIG. 3) whose other end is attached to the front 22 of the spill box, serves to prevent unintentional displacement of the rake and the pull rod as well as of the bottom plate 25.

To fix or locate the spill box 19 with respect to the collecting container 7 and/or to make the spill box extend all the way up to the bottom of the collecting container, the spill box may be provided, at least at one of its transverse or end walls, with a possibly removable extension plate 38 (FIGS. 1 and 4) which makes this wall higher than the side walls of the spill box.

As is apparent from the above, the spill box is so disposed or located on the refuse collecting van that its collecting container serves as a cover or "lid" for the spill box.

The device according to the invention operates and is utilized in the following way:

When the collecting container 7 has become filled and is to be emptied, a garbage can be refuse sack is initially placed under the opening 24 in the bottom 23 of the spill box 19. Subsequently the locking pin 35 or catch is removed and the bottom plate 25 is pulled out until its opening 26 registers with the opening 24. After that (or alternatively before the unfastening of the catch and the pulling out of the bottom plate) the collecting container is pivoted upwards or raised, thereby rupturing the refuse string extending from the loading hopper 15 into the collecting container 7, so that some waste falls down into the spill box 19. After that the refuse is raked down from the spill box into the garbage can by the rake 31 by pulling the grip 33, the rake and the bottom plate being subsequently pushed back into their initial positions. The garbage can is suitably emptied into the loading hopper.

The embodiment described above and illustrated in the drawings is, of course, to be regarded merely as a non-limiting example and may as to its details be modified in several ways within the scope of the following claims. Thus, the front of the spill box may be made removable or pivotable, and the opening thus created may replace the opening 24 in the bottom of the spill box. Alternatively the whole spill box may be made removable.

What I claim is:

1. Improvement in refuse trucks and similar vehicles comprising a collecting container for waste or refuse, said collecting container being movable between first and second positions, loading hopper means for the waste or refuse, said loading hopper means being located adjacent the collecting container, said loading hopper means and said collecting container having mutually registering openings in adjacent confronting walls, and means for compressing the waste or refuse and transferring it from the loading hopper means to the collecting container through said mutually registering openings, wherein a spill box is provided under that end of the collecting container which is adjacent to the loading hopper means for catching refuse displaced from between said collecting container and loading hopper means during relative movement of the collecting container and loading hopper means, said spill box having an open top, said open top being at least substantially covered by said collecting container end when the collecting container is in sad first position and being substantially uncovered when said collecting container is in said second position.

2. The improvement according to claim 1, wherein said collecting container is pivotally movable, said first position being a lowered position and said second position being a raised position, said spill box being substantially covered by said collecting container in said lowered position.

3. The improvement according to claim 2, said spill box projecting beyond said container in the direction of the loading hopper.

4. The improvement according to claim 1, wherein said spill box has an opening in one of the ends, and further comprising a movable shutter for openably closing said spill box end opening.

5. The improvement according to claim 3, wherein said spill box has an opening in one of the ends, and further comprising a movable shutter for openably closing said spill box end opening.

6. Improvement according to claim 5, characterized in that the opening is provided in the bottom of the spill box, and in that said shutter is a slidable plate which covers the opening in a first position and exposes or uncovers it in a second position.

7. Improvement according to claim 6, characterized in that the plate has a first portion, which is unpenetrable for the refuse and covers the bottom opening in the first position of the plate, and an opening located beside said first portion and registering with the opening in the bottom of the spill box in said second position of the plate.

8. Improvement according to claim 5, characterized in that the spill box is provided with a displaceable piston or rake which normally, e.g. at refuse transport, is located in the spill box at that end thereof which is remote from said opening.

9. Improvement according to claim 8, characterized in that the rake has a pull rod which is attached to the rake and in the normal position of the rake extends substantially through the whole spill box and projects through an opening provided in that wall of the spill box which is adjacent to the bottom opening of the spill box.

10. Improvement according to claim 9, characterized in that the pull rod is displaceable in an opening provided in at least one flange belonging to the shutter and being provided outside the spill box, adjacent to one of its ends.

11. Improvement according to claim 9, characterized by the provision of locking or catch means by means of which the rake and the pull rod are lockable in the normal position of the rake.

12. Improvement according to claim 2, characterized in that the spill box has two longitudinal walls and two end walls, of which at least one is extended upwards by cover plates, said one end wall being thus higher than the longitudinal walls.

* * * * *